US010160933B2

(12) United States Patent
Mussmann et al.

(10) Patent No.: US 10,160,933 B2
(45) Date of Patent: Dec. 25, 2018

(54) CARE PRODUCT FOR AUTOMATIC DISHWASHERS HAVING AN OPTIMISED SURFACTANT COMBINATION

(71) Applicant: Henkel AG & Co. KGaA, Duesseldorf (DE)

(72) Inventors: Nina Mussmann, Willich (DE); Inga Kerstin Vockenroth, Duesseldorf (DE); Noelle Wrubbel, Duesseldorf (DE); Thorsten Bastigkeit, Wuppertal (DE); Hans Hartmut Janke, Korschenbroich (DE)

(73) Assignee: Henkel AG & Co. KGaA (DE)

( * ) Notice: Subject to any disclaimer, the term of this patent is extended or adjusted under 35 U.S.C. 154(b) by 0 days.

(21) Appl. No.: 15/247,708

(22) Filed: Aug. 25, 2016

(65) Prior Publication Data

US 2016/0362633 A1 Dec. 15, 2016

Related U.S. Application Data

(63) Continuation of application No. PCT/EP2015/056038, filed on Mar. 23, 2015.

(30) Foreign Application Priority Data

Mar. 26, 2014 (DE) ..... 10 2014 205 641

(51) Int. Cl.

| | |
|---|---|
| ***C11D 1/02*** | (2006.01) |
| ***C11D 1/72*** | (2006.01) |
| ***C11D 1/722*** | (2006.01) |
| ***C11D 1/83*** | (2006.01) |
| ***B08B 3/04*** | (2006.01) |
| ***C11D 1/825*** | (2006.01) |
| ***C11D 11/00*** | (2006.01) |
| ***C11D 17/04*** | (2006.01) |

(52) U.S. Cl.

CPC ..... *C11D 1/72* (2013.01); *C11D 1/8255* (2013.01); *C11D 11/0041* (2013.01); *C11D 17/042* (2013.01); *C11D 1/721* (2013.01); *C11D 1/722* (2013.01)

(58) Field of Classification Search

CPC ..... C11D 1/72; C11D 1/722; C11D 1/825; C11D 1/02; C11D 1/83; B08B 3/04

See application file for complete search history.

(56) References Cited

U.S. PATENT DOCUMENTS

| | | | | |
|---|---|---|---|---|
| 4,392,977 | A | 7/1983 | Altenschopfer et al. | |
| 6,475,296 | B1 | 11/2002 | Gauchon et al. | |
| 6,939,840 | B2 * | 9/2005 | Lichtenberg | A01N 33/08 510/123 |
| 2003/0148907 | A1 | 8/2003 | Black | |
| 2006/0118141 | A1 | 6/2006 | Andriola et al. | |
| 2011/0139182 | A1 * | 6/2011 | Lapham | C11D 1/66 134/18 |

FOREIGN PATENT DOCUMENTS

| | | | |
|---|---|---|---|
| EP | 1600497 | A1 | 11/2005 |
| EP | 1686097 | A1 | 8/2006 |
| FR | 2776299 | A1 | 9/1999 |

OTHER PUBLICATIONS

PCT International Search Report (PCT/EP2015/056038) dated Jun. 29, 2015.

* cited by examiner

*Primary Examiner* — Brian P Mruk

(74) *Attorney, Agent, or Firm* — Bojuan Deng

(57) ABSTRACT

The invention relates to a care product for automatic dishwashers, which is effective against fat deposits in an automatic dishwasher, and includes at least one fatty alcohol of the formula $R^1$—O-$(EO)_m$—H as defined here. The invention further relates to the use of said care product for cleaning and/or care of an automatic dishwasher, and to a method for cleaning and/or care of a dishwasher using said care product.

13 Claims, No Drawings

CARE PRODUCT FOR AUTOMATIC DISHWASHERS HAVING AN OPTIMISED SURFACTANT COMBINATION

FIELD OF THE INVENTION

The present invention generally relates to a care product for automatic dishwashers, which is effective against fat deposits in an automatic dishwasher effective and can be used, for example, together with an automatic dishwashing agent in a normal dishwashing cycle, the use of said care product for cleaning and/or care of an automatic dishwasher, and a method for cleaning and/or care of a dishwasher with the use of said care product.

BACKGROUND OF THE INVENTION

The increasing use of low-temperature and short programs in automatic dishwashers has the result that fewer greasy residues are removed. This can lead to accumulation of these residues, which negatively affect the rinse performance and can cause dishwasher failure.

There is a need therefore for machine care products for automatic dishwashers, which can efficiently remove greasy residues in the dishwasher with use of a smaller amount preferably in the dishwasher cleaning programs.

It has now been found that a care product for automatic dishwashers that includes a fatty alcohol ethoxylate of the formula (I): $R^1$—O-$(EO)_m$—H, where $R^1$ is a linear or branched, substituted or unsubstituted alkyl group having 16 to 18 C atoms, EO is an ethylene oxide unit, and m is 20 to 30, preferably 22 to 27, in particular 25, has very good grease-cutting properties, and good emulsifying power and foam control. Therefore, smaller amounts are needed when a care product including a fatty alcohol ethoxylate of the formula (I) is used in comparison with care products known from the state of the art. The fatty alcohol ethoxylate of the formula (I) is preferably present in solid form at 25° C. and therefore does not reduce the pourability of a solid care product and can be incorporated in any amount.

Furthermore, other desirable features and characteristics of the present invention will become apparent from the subsequent detailed description of the invention and the appended claims, taken in conjunction with this background of the invention.

BRIEF SUMMARY OF THE INVENTION

Use of a composition including at least one fatty alcohol ethoxylate of the formula (I)

$$R^1\text{—O-}(EO)_m\text{—H} \quad \text{(I)},$$

where $R^1$ is a linear or branched, substituted or unsubstituted alkyl group having 16 to 18 C atoms; EO is an ethylene oxide unit; and m is 20 to 30, preferably 22 to 27, in particular 25; wherein the fatty alcohol ethoxylate (I) is included in an amount of 1 to 18% by weight, preferably 6 to 13% by weight, particularly preferably 9 to 10% by weight, based on the composition, and the absolute amount of the at least one fatty alcohol ethoxylate of the formula (I) in the composition is 0.1 to 4 g/job, preferably 1 to 3 g/job, particularly preferably 1.5 to 2.5 g/job, for example, 2 g/job, for cleaning and care of an automatic dishwasher.

A method for cleaning and/or care of an automatic dishwasher, characterized in that a care product for automatic dishwashers is used, wherein the care product includes at least one fatty alcohol ethoxylate of the formula (I)

$$R^1\text{—O-}(EO)_m\text{—H} \quad \text{(I)}$$

where $R^1$ is a linear or branched, substituted or unsubstituted alkyl group having 16 to 18 C atoms; EO is an ethylene oxide unit; and m is 20 to 30, preferably 22 to 27, in particular 25; wherein the fatty alcohol ethoxylate of the formula (I) is included in an amount of 1 to 18% by weight, preferably 6 to 13% by weight, particularly preferably 9 to 10% by weight, based on the care product, and the absolute amount of the at least one fatty alcohol ethoxylate of the formula (I) in the care product is 0.1 to 4 g/job, preferably 1 to 3 g/job, particularly preferably 1.5 to 2.5 g/job, for example, 2 g/job.

A care product for automatic dishwashers containing a fatty alcohol ethoxylate of the formula (I)

$$R^1\text{—O-}(EO)_m\text{—H} \quad \text{(I)},$$

where $R^1$ is a linear or branched, substituted or unsubstituted alkyl group having 16 to 18 C atoms; EO is an ethylene oxide unit; and m is 20 to 30, preferably 22 to 27, in particular 25; wherein the fatty alcohol ethoxylate of the formula (I) is included in an amount of 1 to 18% by weight, preferably 6 to 13% by weight, particularly preferably 9 to 10% by weight, based on the care product, and the absolute amount of the at least one fatty alcohol ethoxylate of the formula (I) in the care product is 0.1 to 4 g/job, preferably 1 to 3 g/job, particularly preferably 1.5 to 2.5 g/job, for example, 2 g/job.

DETAILED DESCRIPTION OF THE INVENTION

The following detailed description of the invention is merely exemplary in nature and is not intended to limit the invention or the application and uses of the invention. Furthermore, there is no intention to be bound by any theory presented in the preceding background of the invention or the following detailed description of the invention.

In a first aspect, the present invention consequently is directed to the use of a composition containing at least one fatty alcohol ethoxylate of the formula (I) $R^1$—O-$(EO)_m$—H, where $R^1$ is a linear or branched, substituted or unsubstituted alkyl group having 16 to 18 C atoms, EO is an ethylene oxide unit, m is 20 to 30, preferably 22 to 27, in particular 25, and wherein the fatty alcohol ethoxylate (I) is included in an amount of 1 to 18% by weight, preferably 6 to 13% by weight, in particular 9 to 10% by weight, based on the composition, and the absolute amount of the at least one fatty alcohol ethoxylate (I) in the composition is 0.1 to 4 g/job, preferably 1 to 3 g/job, in particular 1.5 to 2.5 g/job, for example, 2 g/job, for cleaning and care of an automatic dishwasher.

Likewise a subject of the present invention is a method for cleaning and/or care of an automatic dishwasher, wherein a care product for automatic dishwashers is used containing at least one fatty alcohol ethoxylate of the formula (I) $R^1$—O-$(EO)_m$—H, where $R^1$ is a linear or branched, substituted or unsubstituted alkyl group having 16 to 18 C atoms, EO is an ethylene oxide unit, m is 20 to 30, preferably 22 to 27, in particular 25, wherein the fatty alcohol ethoxylate (I) is included in an amount of 1 to 18% by weight, preferably 6 to 13% by weight, in particular 9 to 10% by weight, based on the care product, and the absolute amount of the at least one fatty alcohol ethoxylate (I) in the care product is 0.1 to 4 g/job, preferably 1 to 3 g/job, in particular 1.5 to 2.5 g/job, for example, 2 g/job.

Lastly, the present invention is directed to a care product for automatic dishwashers including a fatty alcohol ethoxylate of the formula (I) $R^1$—O-$(EO)_m$—H, where $R^1$ is a linear or branched, substituted or unsubstituted alkyl group having 16 to 18 C atoms, EO is an ethylene oxide unit, m is 20 to 30, preferably 22 to 27, in particular 25, wherein the fatty alcohol ethoxylate (I) is included in an amount of 1 to 18% by weight, preferably 6 to 13% by weight, in particular 9 to 10% by weight, based on the care product, and the absolute amount of the at least one fatty alcohol ethoxylate (I) in the composition is 0.1 to 4 g/job, preferably 1 to 3 g/job, in particular 1.5 to 2.5 g/job, for example, 2 g/job.

In the described use, the composition can be employed together with an automatic dishwashing agent in a normal cleaning cycle for cleaning dirty dishware. This has the advantage that running an empty cycle in the machine at high water temperatures is avoided. Energy and water are therefore not wasted. Furthermore, the user need not empty the machine during daily operation, but can simultaneously also clean the machine with the dishware. Routine cleaning of the machine is facilitated due to this minimal effort for the user. In such a case, there is no accumulation of tenacious dirt in the dishwasher which can be removed only under harsh conditions. Furthermore, there is a saving of time, water, and energy due to the simultaneous use of the machine care product in the dishwashing cycle.

"At least one," as used herein, includes but is not limited to 1, 2, 3, 4, 5, 6, and more.

A "normal cleaning cycle," as used herein, refers to an automatic dishwasher program for cleaning dishware. This type of cleaning cycle can comprise one or more pre-rinse steps, one or more main washing steps, and one or more drying steps. A cleaning cycle of this type includes the automatic cleaning/rinsing of dirty dishware.

These and other aspects, features, and advantages of the invention become apparent to the skilled artisan from studying the following detailed description and claims. In this regard, every feature from one aspect of the invention may be used in every other aspect of the invention. Moreover, it goes without saying that the examples included herein are intended to describe and illustrate the invention, but do not limit the same, and in particular the invention is not limited to these examples. All percentage information is percent by weight, unless otherwise stated. Numerical ranges indicated in the format "from x to y" include the mentioned values. If several preferred numerical ranges are indicated in this format, it goes without saying that all ranges resulting from the combination of the different end points are likewise covered.

The fatty alcohol ethoxylate used in the care products and compositions described herein has the formula (I)

$$R^1\text{—O-}(EO)_m\text{—H} \qquad \text{(I)},$$

where $R^1$ is a linear or branched, substituted or unsubstituted alkyl group having 16 to 18 C atoms;

EO is an ethylene oxide unit; and m is 20 to 30, preferably 22 to 27, in particular 25.

In one embodiment, the alkyl group $R^1$ is a linear, preferably unsubstituted, alkyl group having 16 to 18 C atoms.

The fatty alcohol ethoxylate of the formula (I) is included in the composition in an amount of 1 to 18% by weight, preferably 6 to 13% by weight, in particular 9 to 10% by weight, based on the composition. Such amounts are necessary to assure sufficient grease cutting and removal.

The absolute amount of the at least one fatty alcohol ethoxylate of the formula (I) in the composition is 0.1 to 4 g/job, preferably 1 to 3 g/job, in particular 1.5 to 2.5 g/job, for example, 2 g/job. The term "g/job" in this regard means that the care product includes the stated amount of fatty alcohol ethoxylate in an amount and form intended for a one-time use. In other words, "g/job" can also be said to refer to the number of grams per use. For example, when a single use product is made the amount present in the single use product is present in an amount of X g/job. It turned out that good results in lime scale removal can be achieved in particular with amounts of the composition of 10 g or more per use.

The fatty alcohol ethoxylate of the formula (I) is preferably a fatty alcohol ethoxylate that is solid under standard conditions (temperature 25° C., pressure 1013 mbar) and can be used preferably in the form of a powder or granular material.

The products described herein in a preferred embodiment contain at least one second fatty alcohol alkoxylate of the formula (II)

$$R^2\text{-}(AO)_w\text{—}R^3 \qquad \text{(II)},$$

where $R^2$ stands for a linear or branched, substituted or unsubstituted alkyl group having 10 to 16 C atoms;

$R^3$ stands for H or a linear or branched hydrocarbon group having 2 to 26 carbon atoms; each A independently stands for a member from the group comprising —$CH_2CH_2$— and —$CH_2$—$CH(CH_3)$—, $CH_2$—$CH_2$—$CH_2$—, $CH_2$—$CH_2$—$CH_2$—$CH_2$—, —$CH_2$—$CH(CH_2$—$CH_3)$—, —$CH_2$—$C(CH_3)_2$—, or —$CH_2$—$CH_2$—$CH(CH_3)$—, wherein at least one A is —$CH_2CH_2$— and at least one A is —$CH_2$—$CH(CH_3)$—, $CH_2$—$CH_2$—$CH_2$—, $CH_2$—$CH_2$—$CH_2$—$CH_2$—, —$CH_2$—$CH(CH_2$—$CH_3)$—, —$CH_2$—$C(CH_3)_2$—, or —$CH_2$—$CH_2$—$CH(CH_3)$—; and w stands for an integer from 2 to 50, preferably 10 to 30.

In different embodiments, the ratio of the ethylene oxide units and the higher alkylene oxide units in the fatty alcohol alkoxylate of the formula (II) is 12:1 to 1:1, preferably 10:1 to 2:1, in particular 6:1 to 3:1.

Particularly preferred are fatty alcohol alkoxylates of the formula (II) in which $R^2$ is a linear alkyl group having 12-16 C atoms and $R^3$=H and w=10 to 30.

The fatty alcohol alkoxylate of the formula (II) is included in the composition in particular in an amount of 0.01 to 3% by weight, preferably 0.1 to 2% by weight, more preferably 1% by weight, based on the composition. The absolute amount of the fatty alcohol alkoxylate of the formula (II) in the composition is in particular 0.001 to 3 g/job, preferably 0.01 to 1 g/job, more preferably 0.1 to 0.5, very particularly preferably 0.2 g/job. In different optional embodiments of the invention, the weight ratio of the fatty alcohol ethoxylate of the formula (I) and the fatty alcohol alkoxylate of the formula (II) is 20:1 to 1:1, preferably 15:1 to 5:1, in particular 10:1.

Preferred are combinations of 1 to 18% by weight of a fatty alcohol ethoxylate of the formula (I) with 0.1 to 2% by weight of a fatty alcohol alkoxylate of the formula (II), in particular combinations of 6 to 13% by weight of a fatty alcohol ethoxylate of the formula (I) with 0.1 to 2% by weight of a fatty alcohol alkoxylate of the formula (II), for example, also 9 to 10% by weight of a fatty alcohol ethoxylate of the formula (I) with 0.1 to 2% by weight of a fatty alcohol alkoxylate of the formula (II). It is particularly preferred in the aforesaid combinations if the fatty alcohol ethoxylate according to formula (I) has the following parameters: $R^1$=linear C16-18 alkyl-, m=25, and/or the fatty alcohol alkoxylate according to formula (II), where $R^2$ is a linear alkyl group having 12-16 C atoms and $R^3$=H and w=10 to 30.

Preferred furthermore are combinations of 1 to 18% by weight of a fatty alcohol ethoxylate of the formula (I) with 0.5 to 1.5% by weight of a fatty alcohol alkoxylate of the formula (II), in particular combinations of 6 to 13% by weight of a fatty alcohol ethoxylate of the formula (I) with 0.5 to 1.5% by weight of a fatty alcohol alkoxylate of the formula (II), for example, also 9 to 10% by weight of a fatty alcohol ethoxylate of the formula (I) with 0.5 to 1.5% by weight of a fatty alcohol alkoxylate of the formula (II). It is particularly preferred in the aforesaid combinations if the fatty alcohol ethoxylate according to formula (I) has the following parameters: $R^1$=linear C16-18 alkyl-, m=25, and/or the fatty alcohol alkoxylate according to formula (II), where $R^2$ is a linear alkyl group having 12-16 C atoms and $R^3$=H and w=10 to 30.

The fatty alcohol ethoxylate of the formula (II) is also preferably a fatty alcohol ethoxylate that is solid under standard conditions (temperature 25° C., pressure 1013 mbar) and is also used preferably in the form of a powder or granular material.

The embodiments described above in connection with the care products or the use thereof, in particular the embodiments related to the fatty alcohol ethoxylate of the formula (I) and the combination with a fatty alcohol alkoxylate of the formula (II), are similarly suitable for the use, the method, and for the care products according to the present invention. This means that the care products of the invention as well can contain a fatty alcohol ethoxylate of the formula (I), as defined above, optionally in combination with a fatty alcohol alkoxylate of the formula (II), as defined above. Care products of this type can then be used in the described method. In general, all embodiments described herein for the care products can be applied similarly to the described uses and methods and vice versa.

The products described can contain at least one further nonionic surfactant. All nonionic surfactants known to the skilled artisan can be used in this case as nonionic surfactants.

Suitable as nonionic surfactants are, for example, alkyl glycosides having the general formula $RO(G)_x$, in which R corresponds to a primary linear or methyl-branched aliphatic group, especially methyl-branched in the 2-position, having 8 to 22, preferably 12 to 18 C atoms, and G is the symbol for a glycose unit having 5 or 6 C atoms, preferably for glucose. The degree of oligomerization x, which indicates the distribution of monoglycosides and oligoglycosides, is any number between 1 and 10; x is preferably 1.2 to 1.4.

A further class of nonionic surfactants that can be used is alkoxylated, preferably ethoxylated, or ethoxylated and propoxylated fatty acid alkyl esters, preferably having 1 to 4 carbon atoms in the alkyl chain.

Nonionic surfactants of the amine oxide type, for example, N-coco alkyl-N,N-dimethylamine oxide and N-tallow alkyl-N,N-dihydroxyethylamine oxide, and fatty acid alkanolamides can also be suitable. The amount of these nonionic surfactants is preferably no more than that of the ethoxylated fatty alcohols, particularly no more than half thereof.

Further suitable surfactants are the polyhydroxy fatty acid amides known as PHFA.

Lastly, further low-foaming nonionic surfactants from the group of the alkoxylated alcohols can also be used.

In general, the pH of the care compositions described herein can be adjusted by means of conventional pH regulators. The pH of the composition is in a range of 7.0 to 14.0, preferably 8.5 to 12. Alkalis are used preferably as pH adjusting agents. Suitable bases come from the group of alkali and alkaline earth metal hydroxides and carbonates, in particular the alkali metal carbonates, of which sodium carbonate is preferred. Alternatively, acids are used as pH adjusting agents, e.g., citric acid, oxalic acid, or the hydrates thereof.

The products of the invention can contain at least one further component, preferably selected from the group consisting of further surfactants, in particular anionic surfactants, builders, enzymes, thickeners, sequestering agents, electrolytes, corrosion inhibitors, in particular silver protectors, glass corrosion inhibitors, foam inhibitors, dyes, fragrances, bittering substances, and antimicrobial active substances.

In preferred embodiments, the product is phosphate-free and/or phosphonate-free. In further preferred embodiments, the product is bleach-free. "Phosphate-free" and "phosphonate-free," as used herein, means that the relevant composition is substantially free of phosphates or phosphonates, i.e., in particular contains phosphates or phosphonates in amounts less than 0.1% by weight, preferably less than 0.01% by weight, based on the total composition.

Preferred anionic surfactants are fatty alcohol sulfates, fatty alcohol ether sulfates, dialkyl ether sulfates, monoglyceride sulfates, alkylbenzene sulfonates, olefin sulfonates, alkane sulfonates, ether sulfonates, n-alkyl ether sulfonates, ester sulfonates, and lignin sulfonates. Likewise usable in the context of the present invention are fatty acid cyanamides, sulfosuccinates (sulfosuccinic acid esters), in particular sulfosuccinic acid monoalkyl and dialkyl esters having 8 to 18 C atoms, sulfosuccinamates, sulfosuccinamides, fatty acid isethionates, acyl aminoalkane sulfonates (fatty acid taurides), fatty acid sarcosinates, ether carboxylic acids, and alkyl (ether) phosphates and α-sulfofatty acid salts, acyl glutamates, monoglyceride disulfates, and alkyl ethers of glycerol disulfate.

The anionic surfactants are preferably used as sodium salts, but can also be present as other alkali or alkaline earth metals, for example, potassium or magnesium salts, and in the form of ammonium or mono-, di-, tri-, or tetraalkyl ammonium salts, in the case of the sulfonates also in the form of their corresponding acid, e.g., dodecylbenzenesulfonic acid.

The builders that can be used include aminocarboxylic acids and their salts, carbonates, organic cobuilders, and silicates.

Aminocarboxylic acids and/or the salts thereof represent a further important class of builders. Particularly preferred representatives of this class are methylglycinediacetic acid (MGDA) or the salts thereof and glutamine diacetic acid (GLDA) or the salts thereof or ethylenediaminediacetic acid or the salts thereof (EDDS). Likewise suitable are iminodisuccinic acid (IDS) and iminodiacetic acid (IDA). The content of these aminocarboxylic acids or the salts thereof can be, for example, between 0.1 and 70% by weight, preferably between 2 and 60% by weight, and in particular between 5 and 50% by weight, based in each case on the active substance content of the aminocarboxylic acid, based on the total weight of the composition. Aminocarboxylic acids and the salts thereof can be used together with the aforesaid builders, in particular also with the phosphate-free builders.

Particularly preferred are combinations of 5 and 50% by weight of GLDA with 1 to 18% by weight of a fatty alcohol ethoxylate of the formula (I). Furthermore, particularly preferred are combinations of 5 and 50% by weight of GLDA with 1 to 18% by weight of a fatty alcohol ethoxylate of the formula (I) with 0.5 to 1.5% by weight of a fatty alcohol alkoxylate of the formula (II), in particular combinations of 5 and 50% by weight of GLDA with 6 to 13% by weight of a fatty alcohol ethoxylate of the formula (I) with 0.5 to 1.5% by weight of a fatty alcohol alkoxylate of the formula (II), for example, 5 and 50% by weight of GLDA with 9 to 10% by weight of a fatty alcohol ethoxylate of the formula (I) and with 0.5 to 1.5% by weight of a fatty alcohol alkoxylate of the formula (II). It is particularly preferred in the aforesaid combinations if the fatty alcohol ethoxylate according to formula (I) has the following parameters: $R^1$=linear C16-18 alkyl-, m=25, and/or the fatty alcohol alkoxylate according to formula (II), where $R^2$ is a linear alkyl group having 12-16 C atoms and $R^3$=H and w=10 to 30.

Particularly preferred are combinations of 5 and 50% by weight of MGDA with 1 to 18% by weight of a fatty alcohol ethoxylate of the formula (I). Furthermore, particularly preferred are also combinations of 5 and 50% by weight of MGDA with 1 to 18% by weight of a fatty alcohol ethoxylate of the formula (I) with 0.5 to 1.5% by weight of a fatty alcohol alkoxylate of the formula (II), in particular combinations of 5 and 50% by weight of MGDA with 6 to 13% by weight of a fatty alcohol ethoxylate of the formula (I) with 0.5 to 1.5% by weight of a fatty alcohol alkoxylate of the formula (II), for example, 5 and 50% by weight of MGDA with 9 to 10% by weight of a fatty alcohol ethoxylate of the formula (I) and with 0.5 to 1.5% by weight of a fatty alcohol alkoxylate of the formula (II). It is particularly preferred in the aforesaid combinations if the fatty alcohol ethoxylate according to formula (I) has the following parameters: $R^1$=linear C16-18 alkyl-, m=25, and/or the fatty alcohol alkoxylate according to formula (II), where $R^2$ is a linear alkyl group having 12-16 C atoms and $R^3$=H and w=10 to 30.

The percentages by weight given in this application, unless stated otherwise, refer to the active substance content in grams, based on the weight of the total composition in grams.

Polycarboxylates/polycarboxylic acids, polymeric carboxylates, aspartic acid, polyacetals, and dextrins in particular can be mentioned as organic cobuilders.

Usable organic builder substances are, for example, the polycarboxylic acids usable in the form of the free acid and/or the sodium salts thereof, wherein polycarboxylic acids are understood to be carboxylic acids that bear more than one acid function. These are, for example, citric acid, adipic acid, succinic acid, glutaric acid, malic acid, tartaric acid, maleic acid, fumaric acid, sugar acids, aminocarboxylic acids, nitrilotriacetic acid (NTA), provided this type of use is not objectionable for ecological reasons, and mixtures thereof.

Also possible, for example, is the use of carbonate(s) and/or hydrogen carbonate(s), preferably alkali carbonate(s), particularly preferably sodium carbonate. Alkali carbonates, in particular sodium carbonate, can also be used as pH adjusting agents and are present in different embodiments of the invention in an amount of 15-50% by weight, preferably 20-40% by weight, based on the care product/composition.

Other polymeric polycarboxylates are suitable as builders; these are, for example, the alkali metal salts of polyacrylic acid or polymethacrylic acid, for example, those with a relative molecular mass of 500 to 70,000 g/mol.

Suitable polymers are particularly polyacrylates, which preferably have a molecular mass of 2000 to 20,000 g/mol. Because of their superior solubility, in turn the short-chain polyacrylates, which have molecular masses of 2000 to 10,000 g/mol, and particularly preferably of 3000 to 5000 g/mol, can be preferred from this group.

The products furthermore can contain as builders crystalline sheet silicates of the general formula $NaMSi_xO2_{x+1}.yH_2O$, where M represents sodium or hydrogen, x is a number from 1.9 to 22, preferably from 1.9 to 4, particularly preferred values for x being 2, 3, or 4, and y stands for a number from 0 to 33, preferably from 0 to 20. Amorphous sodium silicates may also be used which have a $Na_2O:SiO_2$ modulus of 1:2 to 1:3.3, preferably of 1:2 to 1:2.8, and especially of 1:2 to 1:2.6, which preferably have a delayed dissolution and secondary detergent properties.

In preferred products, the content of silicates, based on the total weight of the dishwashing agent, is limited to amounts less than 10% by weight, preferably less than 5% by weight, and in particular less than 2% by weight. Particularly preferred products are silicate-free.

Individual fragrance compounds, e.g., synthetic products of the ester, ether, aldehyde, ketone, alcohol, and hydrocarbon types, can be used as perfume oils or scents in the context of the present invention. Preferably, however, mixtures of different fragrances are used, which together produce an attractive scent note. Such perfume oils can also contain natural fragrance mixtures, as are obtainable from plant sources, e.g., pine, citrus, jasmine, patchouli, rose, or ylang ylang oil.

The packaging of the care products described herein can occur in different ways. The products can be present in solid or liquid product forms and as a combination of solid and liquid product forms. In particular powders, granules, extrudates, and compactates, in particular tablets, are suitable as solid product forms. The liquid product forms based on water and/or organic solvents can be present thickened, in the form of gels.

In preferred embodiments, the care product has a solid product form. "Solid" in this regard means that the composition exists in solid form under standard conditions (temperature 25° C., pressure 1013 mbar). In different embodiments, the fatty alcohol ethoxylate of the formula (I) is in the solid state at 25° C. (pressure 1013 mbar), for example, as powder or granular material, and, when processed with the other components of the solid care product, does not reduce the pourability of the produced care product and can therefore be incorporated in any amounts.

The products described herein are preferably preformulated into dispensing units. These dispensing units preferably comprise the amount of substances with a washing or cleaning action, said amount being necessary for a cleaning cycle. Preferred dispensing units have a weight between 10 and 40 g, preferably between 20 and 30 g, and especially between 25 g. To achieve an optimal cleaning result, such products are preferred that are present in the form of a prefabricated dispensing unit. The volume of the aforesaid dispensing unit and the shape thereof can be selected so that the preformulated units can be dispensed not via the dispensing chamber of a dishwasher but the unit can be added directly to the interior of the dishwasher.

The products and compositions described herein can have a water-soluble wrapping. Particularly preferably, the prefabricated dispensing units are formed by a water-soluble wrapping of a suitable portion amount of the composition of the invention, which comprises the prefabricated dispensing unit, therefore preferably a product of the invention and a water-soluble wrapping/packaging.

The water-soluble wrapping is preferably made from a water-soluble film material selected from the group comprising polymers or polymer mixtures. The wrapping can be made of one layer or of two or more layers of the water-soluble film material. The water-soluble film material of the first layer and of the further layers, if present, can be the same or different. Particularly preferred are films, which can be glued and/or sealed, for example, to form packagings such as tubes or pillows, after they were filled with a product.

The water-soluble wrappings/packagings are preferably deep-drawn articles or injection molded articles.

The water-soluble containers/wrappings/packagings can also be produced by injection molding. Injection molding in this case means converting a molding material such that the material contained in a barrel for more than one injection molding cycle softens plastically under the effect of heat and flows under pressure through a die into the cavity of an already closed mold. The process is principally used for non-hardenable molding materials, which solidify by cooling in the mold. Injection molding is a very efficient modern process for producing molded objects and is particularly suitable for automated mass production. In practical operation, the thermoplastic molding materials (powder, pellets, diced forms, pastes, inter alial) are heated until liquid (to 180° C.) and then injected under high pressure (up to 140 MPa) in closed, preferably water-cooled two-piece molds, i.e., consisting of a cavity (earlier a matrix) and core (earlier stamp), where they cool and solidify. Plunger and screw injection molding machines are suitable.

Such molded articles can also have one, two, three, or more chambers and be filled with liquid and/or solid compositions, of which one of the compositions is one of the compositions of the invention. It is possible, for example, to close the chambers on the open side either with a second molded article or with one or more water-soluble films (in particular as described herein). Thus, the release of the compositions in the chambers can be controlled as desired according to the desired release time; either the entire amount can be released all at once (either immediately at the start of the cleaning cycle or at a specified time during the cleaning cycle) or by variation of the film composition at specified but different times in the dishwasher cycle (for example, depending on the rinse water temperature).

It is preferred that the water-soluble wrapping includes polyvinyl alcohol or a polyvinyl alcohol copolymer. Water-soluble wrappings, including polyvinyl alcohol or a polyvinyl alcohol copolymer, exhibit good stability with a sufficiently high water solubility, in particular cold water solubility.

Suitable water-soluble films for producing the water-soluble wrapping are preferably based on a polyvinyl alcohol or a polyvinyl alcohol copolymer, the molecular weight of which is in the range of 10,000 to 1,000,000 $gmol^{-1}$, preferably of 20,000 to 500,000 $gmol^{-1}$, particularly preferably of 30,000 to 100,000 $gmol^{-1}$, and in particular of 40,000 to 80,000 $gmol^{-1}$.

Polyvinyl alcohol is typically produced by hydrolysis of polyvinyl acetate, because the direct synthesis route is not possible. The same applies to polyvinyl alcohol copolymers, which are produced accordingly from polyvinyl acetate copolymers. It is preferred if at least one layer of the water-soluble wrapping comprises a polyvinyl alcohol, whose degree of hydrolysis is 70 to 100 mol %, preferably 80 to 90 mol %, particularly preferably 81 to 89 mol %, and in particular 82 to 88 mol %.

A polymer selected from the group comprising (meth) acrylic acid-containing (co)polymers, polyacrylamides, oxazoline polymers, polystyrene sulfonates, polyurethanes, polyesters, polyethers, polylactic acid, or mixtures of the aforesaid polymers, can be added in addition to a polyvinyl alcohol-containing film material that is suitable for producing the water-soluble wrapping. Polylactic acids are a preferred additional polymer.

Preferred polyvinyl alcohol copolymers comprise, in additional to vinyl alcohol, dicarboxylic acids as further monomers. Suitable dicarboxylic acids are itaconic acid, malonic acid, succinic acid, and mixtures thereof, itaconic acid being preferred.

Likewise preferred polyvinyl alcohol copolymers comprise, in addition to vinyl alcohol, an ethylenically unsaturated carboxylic acid, the salt thereof, or esters thereof. Especially preferably, such polyvinyl alcohol copolymers contain acrylic acid, methacrylic acid, acrylic acid esters, methacrylic acid esters, or mixtures thereof, in addition to vinyl alcohol.

It can be preferable that the film material includes further additives. The film material can contain, for example, plasticizers such as dipropylene glycol, ethylene glycol, diethylene glycol, propylene glycol, glycerol, sorbitol, mannitol, or mixtures thereof. Further additives comprise, for example, release aids, filling agents, crosslinking agents, surfactants, antioxidants, UV absorbers, antiblocking agents, non-stick agents, or mixtures thereof.

Suitable water-soluble films for use in the water-soluble wrappings of the water-soluble packagings according to the invention are films marketed by the company MonoSol LLC, for example, under the name M8630, C8400, or M8900. Other suitable films comprise films with the name Solublon® PT, Solublon® GA, Solublon® KC, or Solublon® KL from Aicello Chemical Europe GmbH or the films VF-HP from Kuraray.

The use of the care product of the invention in a water-soluble wrapping has the advantage that, in contrast to the customary bottles, which are sealed with a wax seal, which dissolves only at high water temperatures, the preproportioned dispensing units can be released even at lower temperatures and therefore optionally also earlier in the course of the cleaning process or in the rinse cycle. Such a preproportioned dispensing unit normally also takes up less place than the previously used customary bottles, which can be either hung in the machine or placed in the cutlery basket. Moreover, it can be placed anywhere in the interior of the dishwasher.

Lastly, the invention also relates to a dishwashing method, in particular an automatic dishwashing method, in which a care product according to the invention is used. The subject of the present invention, therefore, furthermore is a method for cleaning dishware in a dishwasher, in which the care product of the invention is dispensed during the running of a dishwashing program before the start of the main wash cycle or during the main wash cycle in the interior of a dishwasher. The dispensing or the introduction of the product of the invention into the interior of the dishwasher can occur manually.

EXAMPLES

Example 1

In order to determine the performance of a machine care product against grease, the filter of the automatic dishwasher was first soiled with grease, in order to then determine the performance of the machine care product in this soiled machine:

Machine: Bosch SMS 86M12

Program: 70° C. intensive

Grease/dirt: 40 g of suet plus 20 g of Barilla pasta sauce

The filter (two-part) was weighed dry before the cycle. The suet and pasta sauce were added directly to the dishwasher and a commercial dishwashing agent (Somat 7, Henkel, DE) was placed in the dispensing compartment. A cycle with the intensive 70° C. program was then run. Next, the filter was removed, the remaining water was allowed to drip off for 30 minutes, and the built-up grease amount was determined using a scale.

The soiled filter was then again placed in the machine, the formulation to be tested was added to the dispensing chamber, and the ECO50° C. program of the dishwasher was run. Next, the filter was again removed and weighed after dripping off for 30 minutes to determine the grease amount removed by the tested product (remaining residual amounts of grease in %). Genapol® T250P (Clariant, active substance content 100%) was used as the fatty alcohol ethoxylate of the formula (I) and Plurafac® LF220 (BASF, SE, active substance content 100%) as the fatty alcohol alkoxylate of the formula (II). V1 and V2 are comparison formulations; E1-E4 are machine care product formulations according to the invention (the quantitative data given below refer to the active substance content of the listed substances):

| Raw | V2 | | E1 | | E2 | | E3 | | V1 | | E4 | |
|---|---|---|---|---|---|---|---|---|---|---|---|---|
| material | % | g/job | % | g/job | % | g/job | % | g/job | % | g/job | % | g/job |
| Plurafac 220 | 5.7 | 2.0 | 5.7 | 2.0 | 5.7 | 2.0 | 0 | 0 | 40.0 | 14.0 | 1.0 | 0.2 |
| MGDA | 25 | 8.75 | 25 | 8.75 | 25 | 8.75 | 25 | 8.75 | 0 | 0 | 40 | 8.4 |
| Sulfate | 69.2 | 24.25 | 66.3 | 23.25 | 63.5 | 22.25 | 69.2 | 24.25 | 0 | 0 | 48.4 | 10.28 |
| Genapol T250P | 0.0 | 0 | 2.9 | 1.0 | 5.7 | 2.0 | 5.7 | 2.0 | 0 | 0 | 10.0 | 2.0 |
| Perfume | 0.1 | 0 | 0.1 | 0 | 0.1 | 0 | 0.1 | 0 | 0.1 | 0 | 0.1 | 0.02 |
| Acid | 0 | 0 | 0 | 0 | 0 | 0 | 0 | 0 | 60.0 | 21.0 | 0.5 | 0.1 |
| Total | 100 | 35 | 100 | 35 | 100 | 35 | 100 | 35 | 100 | 35 | 100 | 21 |

V2: 37% grease residue
E1: 20% grease residue
E2: 13% grease residue
E3: 24% grease residue
V1: 10% grease residue The results show that formulations with a very high amount of Plurafac 220 (V1) exhibit very good grease-cutting power, but this decreases greatly with a reduction of the surfactant amount (V2). A combination of the surfactants of the invention in small amounts (E2) exhibits a grease-cutting power which is comparable to that of the comparison formulation (V1), including a much higher amount of surfactant. The surfactant of the formula (I) as described herein (E3) in the direct comparison with a surfactant of the formula (II) (V2) exhibits a considerably higher grease-cutting power.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

What is claimed is:

1. A method for cleaning and/or care of an automatic dishwasher, comprising placing an amount of a care product for automatic dishwashers in the automatic dishwasher; and running the automatic dishwasher, wherein the care product includes at least one fatty alcohol ethoxylate of the formula (I)

$$R^1—O-(EO)_m—H \quad (I)$$

where $R^1$ is a linear or branched, substituted or unsubstituted alkyl group having 16 to 18 C atoms; EO is an ethylene oxide unit; and m is 20 to 30;

wherein the fatty alcohol ethoxylate of the formula (I) is included in an amount of 6% to 13% by weight, based on the care product, and the absolute amount of the at least one fatty alcohol ethoxylate of the formula (I) in the care product is 0.1 to 4 g/run or job;

at least one fatty alcohol alkoxylate of the formula (II)

$$R^2-(AO)_w—R^3 \quad (II),$$

where $R^2$ stands for a linear or branched, substituted or unsubstituted alkyl group having 10 to 16 C atoms; $R^3$ stands for H or a linear or branched hydrocarbon group having 2 to 26 carbon atoms; each A independently stands for a member from the group comprising $—CH_2CH_2—$ and $—CH_2—CH(CH_3)—$, $CH_2—CH_2—CH_2—$, $CH_2—CH_2—CH_2—CH_2—$, $—CH_2—CH(CH_2—CH_3)—$, $—CH_2—C(CH_3)_2—$, or $—CH_2—CH_2—CH(CH_3)—$, wherein at least one A is $—CH_2CH_2—$ and at least one A is $—CH_2—CH(CH_3)—$, $CH_2—CH_2—CH_2—$, $CH_2—CH_2—CH_2—CH_2—$, $—CH_2—CH(CH_2—CH_3)—$, $—CH_2—C(CH_3)_2—$, or $—CH_2—CH_2—CH(CH_3)—$; and w stands for an integer from 2 to 50, wherein the fatty alcohol alkoxylate of the formula (II) is included in an amount of 0.01 to 3% by weight, and the weight ratio of the fatty alcohol ethoxylate of the formula (I) and the fatty alcohol alkoxylate of the formula (II) in the care product is 20:1 to 2:1, and at least one anioic surfactant.

2. The method according to claim 1, wherein the amount of the at least one fatty alcohol ethoxylate of formula (I) comprises 1 to 3 g/run or job.

3. A care product for automatic dishwashers including a fatty alcohol ethoxylate of the formula (I)

$$R^1—O-(EO)_m—H \quad (I),$$

where $R^1$ is a linear or branched, substituted or unsubstituted alkyl group having 16 to 18 C atoms; EO is an ethylene oxide unit; and m is 20 to 30;

wherein the fatty alcohol ethoxylate of the formula (I) is included in an amount of 6% to 13% by weight, based on the care product, and the absolute amount of the at least one fatty alcohol ethoxylate of the formula (I) in the care product is 0.1 to 4 g/job; and at least one fatty alcohol alkoxylate of the formula (II)

$$R^2\text{-}(AO)_w\text{—}R^3 \quad \text{(II)},$$

where $R^2$ stands for a linear or branched, substituted or unsubstituted alkyl group having 10 to 16 C atoms; $R^3$ stands for H or a linear or branched hydrocarbon group having 2 to 26 carbon atoms; each A independently stands for a member from the group comprising —$CH_2CH_2$— and —$CH_2$—$CH(CH_3)$—, $CH_2$—$CH_2$—$CH_2$—, $CH_2$—$CH_2$—$CH_2$—$CH_2$—, —$CH_2$—$CH(CH_2$—$CH_3)$—, —$CH_2$—$C(CH_3)_2$—, or —$CH_2$—$CH_2$—$CH(CH_3)$—, wherein at least one A is —$CH_2CH_2$— and at least one A is —$CH_2$—$CH(CH_3)$—, $CH_2$—$CH_2$—$CH_2$—, $CH_2$—$CH_2$—$CH_2$—$CH_2$—, —$CH_2$—$CH(CH_2$—$CH_3)$—, —$CH_2$—$C(CH_3)_2$—, or —$CH_2$—$CH_2$—$CH(CH_3)$—; and w stands for an integer from 2 to 50, wherein the fatty alcohol alkoxylate of the formula (II) is included in an amount of 0.01 to 3% by weight, and the weight ratio of the fatty alcohol ethoxylate of the formula (I) and the fatty alcohol alkoxylate of the formula (II) in the care product is 20:1 to 2:1, and at least one anionic surfactant.

4. The care product according to claim 3, wherein the fatty alcohol ethoxylate of formula (I) comprises 9 to 10% by weight based on the care product.

5. The care-product according to claim 3, wherein the care product/composition is phosphate-free and/or phosphonate-free.

6. The care-product according to claim 3, wherein the care product/composition (a) is present in solid form; and/or (b) is present in preproportioned form; and/or (c) is located in a water-insoluble, water-soluble, or water-dispersible packaging.

7. The care-product according to claim 3, wherein the care product further comprises at least one component selected from the group consisting of builders, further surfactants, polymers, enzymes, corrosion inhibitors, glass corrosion inhibitors, disintegration aids, fragrances, and perfume carriers.

8. The care-product according to claim 3, wherein m is 22 to 27.

9. The care-product according to claim 3, wherein m is 25.

10. The care-product according to claim 3, wherein the absolute amount of the at least one fatty alcohol ethoxylate of the formula (I) in the care product is 1 to 3 g/job.

11. The care-product according to claim 3, wherein the absolute amount of the at least one fatty alcohol ethoxylate of the formula (I) in the care product is 2 g/job.

12. The method according to claim 1, wherein m is 22 to 27.

13. The method according to claim 1, wherein m is 25.

* * * * *